US005802880A

United States Patent [19]

min

[11] Patent Number: 5,802,880

[45] Date of Patent: Sep. 8, 1998

[54] IMPROVEMENT OF YARN SUPPLY REEL AND YARN GUIDE FOR KNITTING MACHINES

[76] Inventor: Lin Chung min, No. 4, Aly. 122, Ln. 352, Sec. 1, Chungshan Rd., Yungho, Taipei, Taiwan

[21] Appl. No.: 781,709

[22] Filed: Jan. 10, 1997

[51] Int. Cl.[6] ..... D04B 15/48

[52] U.S. Cl. ..... 66/132 R; 66/132 T; 242/47.05

[58] Field of Search ..... 242/47.01, 47.05; 66/132 R, 132 T

[56] References Cited

U.S. PATENT DOCUMENTS 3,709,444 1/1973 Tannert ..... 66/132 R
4,574,597 3/1986 Buck et al. ..... 242/47.01
4,793,565 12/1988 Fecker ..... 242/47.01
5,590,547 1/1997 Conzelmann ..... 66/132 R

*Primary Examiner*—Andy Falik
*Attorney, Agent, or Firm*—W. Wayne Liauh

[57] ABSTRACT

A yarn supply reel and yarn guide for use in a knitting machine includes a driving reel with a plurality of spaced struts arranged in an annular shape and a driven reel with a plurality of spaced ribs arranged in an annular shape. The ribs have slanted and curved lateral surfaces to allow a yarn to be wound around thereon and then slip and wind around the struts smoothly. The yarn guide has smooth surfaces and edges and enables a yarn coming from the yarn supply reel to pass therethrough to a needle at a constant tension without sticking. Both the yarn supply reel and the yarn guiding yarn are made by plastics injection molding for reduced cost and enhanced quality.

2 Claims, 5 Drawing Sheets

IMPROVEMENT OF YARN SUPPLY REEL AND YARN GUIDE FOR KNITTING MACHINES

BACKGROUND OF THE INVENTION

1. Field of the Invention

The present invention relates to an improvement of yarn supply reel and yarn guide for knitting machine, and, more particularly to the yarn supply reel and yarn guide made using a plastics injection molding process that provide the advantages of high precision, being easy to produce and low cost.

2. Description of the Prior Art

In the automatic operation of knitting machines, it usually involves the step of having a yarn drawn out from a bobbin and wound around a yarn supply reel for a number of times before leading the yarn to a yarn guide and a needle for the knitting process. The yarn supply reel and yarn guide are used for providing even yarn tension to produce consistent and high quality knitted products.

FIG. 1 shows a conventional yarn supply reel A which has a "⊢" shape ribs B formed in an annular manner. Reel A is mounted on a frame H of a yarn feeding means of a knitting machine. The upper portion of the ribs B is slanted outwardly to form a yarn guiding section C, while the lower portion is slanted inwardly at an angle about three degrees to form a yarn winding section D. A yarn E goes through the yarn guide section C and yarn winding section D, and exits from the lower portion of the reel A, so that the yarn may be supplied during the knitting process with a steady and even tension.

There are several disadvantages in the conventional structure set forth above. For instance, the "⊢" shape rib B is usually formed by a stainless bar which, in general, does not possess the same hardness from the top end to the bottom end. Furthermore, stainless steel has a resilient characteristic which reacts to the pressing force differently from the top end to the bottom end. Therefore, the profile and shape of each rib B will not be exactly the same. The yarn supply reel made using the ribs B thus cannot be a genuine circle. The yarn supply consequently cannot be totally evenly done; this will adversely affect the knitting quality or even produce defective knitting products.

FIG. 2 shows a yarn guide F used in a conventional knitting machine. It is usually made by a metal plate by pressing or stamping. There is a porcelain rod G located in a front end. The curvature and wear-resistant property of the porcelain rod G enables a yarn E to move thereon smoothly to a needle. However, the porcelain rod G can easily become loose and come off from the frame F. Yarn E can also easily get caught and become stuck in the wedge slot formed between the porcelain rod G and the frame F, and resulting in yarn being broken. Under such circumstance, the knitting machine must be stopped for trouble shooting. It thus seriously cuts down production efficiency.

SUMMARY OF THE INVENTION

It is an object of this invention to provide an improvement of yarn supply reel and yarn guide that are made by plastics injection molding. There is a driven reel with a plurality of taper ribs arranged in an annular manner and engaged with a driving reel for supplying yarn evenly. The present invention reduces the knitting cost and simplifies the knitting process.

It is another object of this invention to provide an improvement of yarn supply reel and yarn guide that are made by plastics injection molding so that the curvature of the driven reel can be more precisely formed and consequently can improve the product quality.

It is a further object of this invention to provide a yarn guide made by plastic injection molding that has smooth and curved contour, and has a pair of spaced slots for holding a porcelain rod without creating wedge slot therebetween. Thus, a yarn can be moved thereon smoothly without sticking or interruption.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
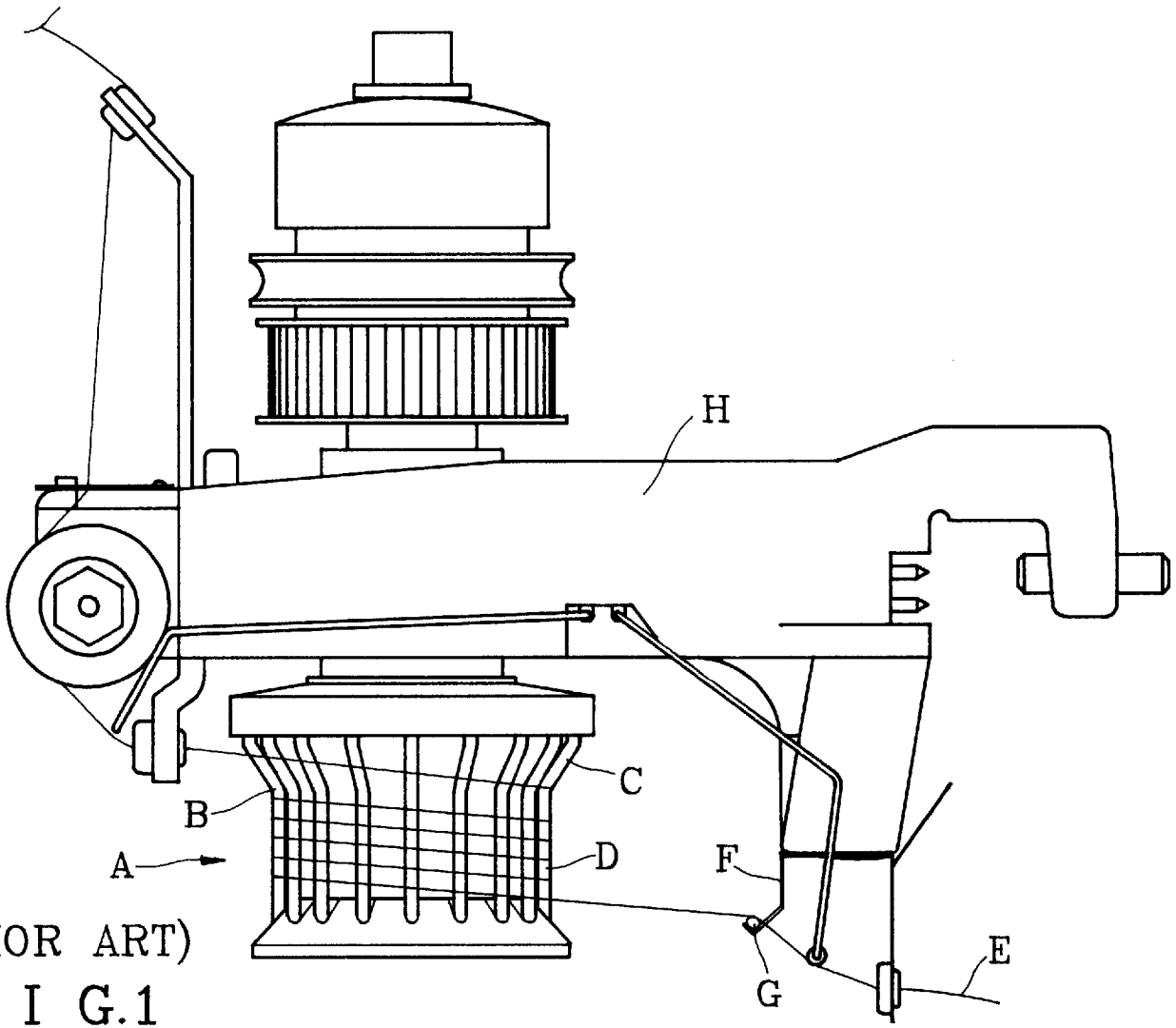
(PRIOR ART) FIG.1
FIG. 1 is a side view of a yarn supply reel used in a conventional knitting machine.
Figure 2:
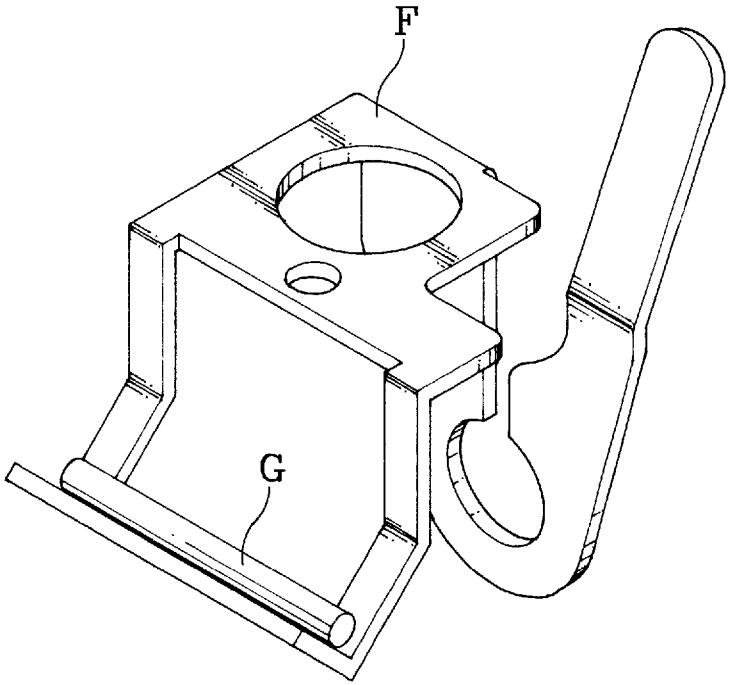
(PRIOR ART) FIG.2
FIG. 2 is an exploded view of a conventional yarn guide.
Figure 3:
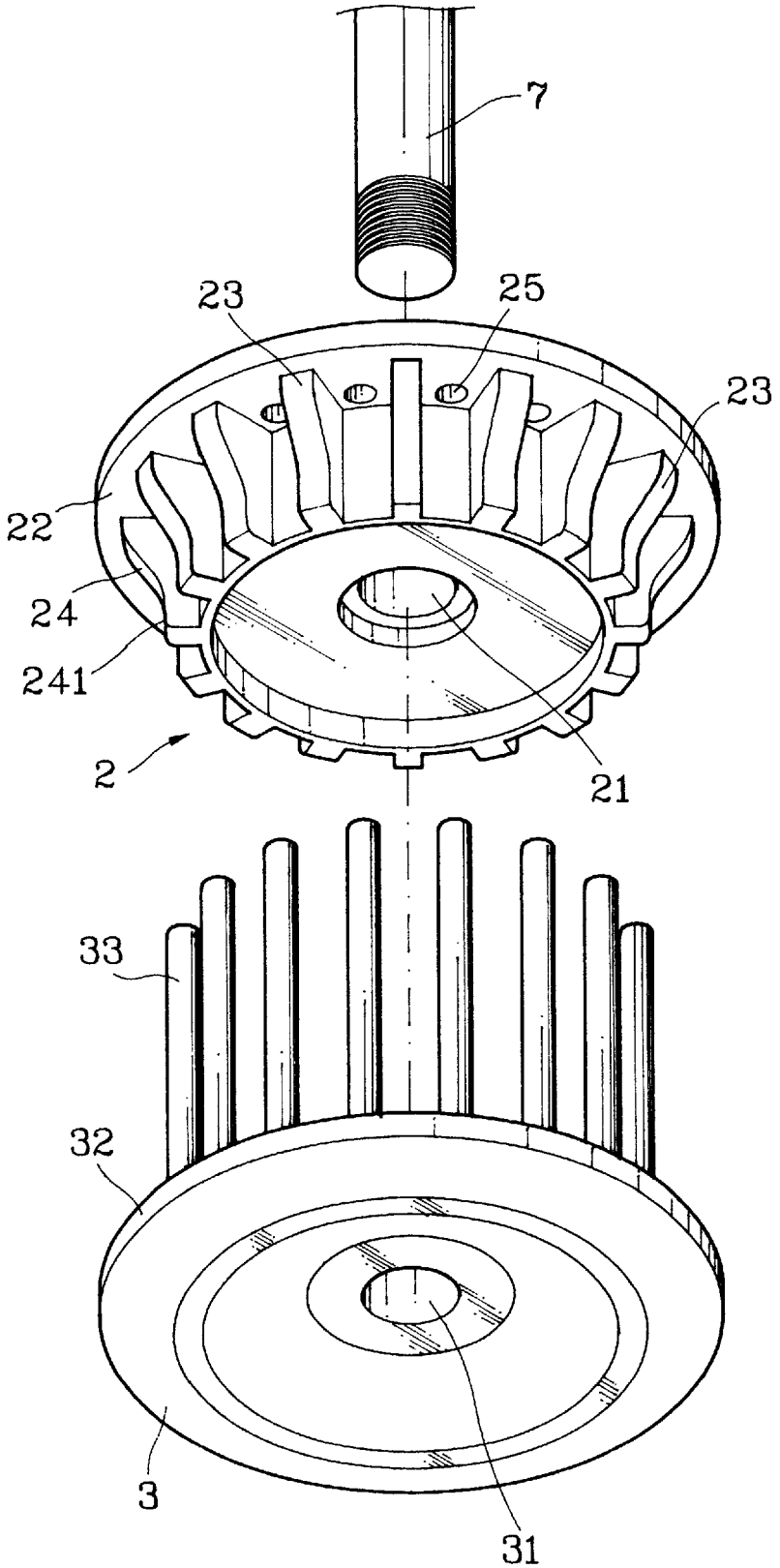
FIG. 3 is an exploded view of this invention.

Referring now to FIG. 3, which shows that a yarn supply reel and a yarn guide of the present invention are mounted on a yarn supply frame of a knitting machine (not shown in the figure). The yarn supply reel 1 includes a driving reel 3 and a driven reel 2 engaging with each other. The driven reel 2 has a first spindle opening 21 in the center and a first flange 22. Under the first flange 22, there are a plurality of spaced ribs 23 arranged in an annular manner. Each rib 23 has a slanted curve surface 24 pointing downwardly and inwardly. There is an aperture 25 formed in the flange 22 between a pair of ribs 23. The driving reel 3 has a second spindle opening 31 in the center and a second flange 32. Upon the flange 32, there are a plurality of spaced struts 33 formed vertically in annular manner and are engageable with the apertures 25 of the driven reel 2.

Figure 4:
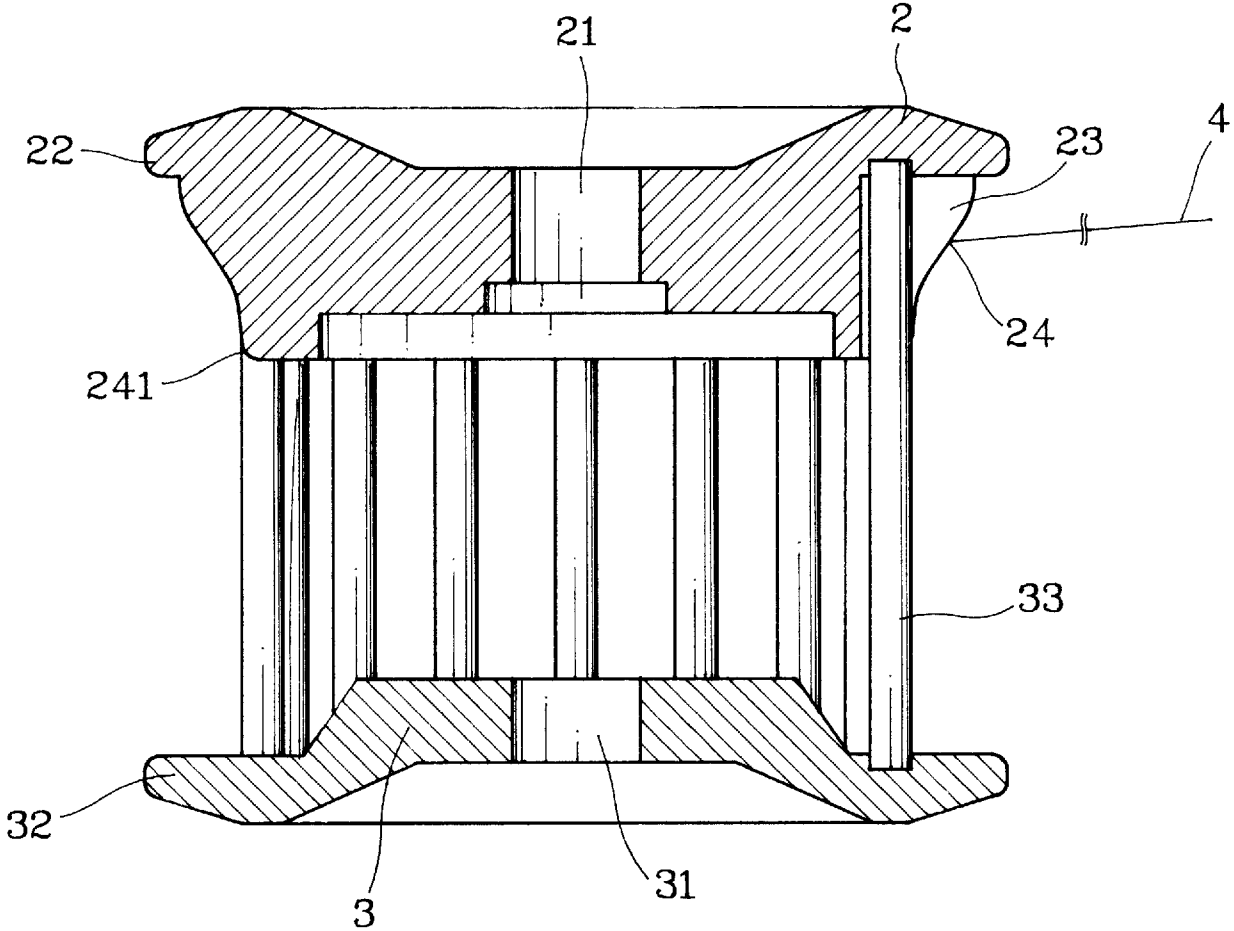
FIG. 4 is a sectional view of this invention.

Referring to FIGS. 3 and 4, the driving reel 3 and the driven reel 2 are engaged with the struts 33 held in the apertures 25. A transmission spindle 7 of the knitting machine runs through the first spindle opening 21 and engages with second spindle opening 31. Therefore the rotating spindle 7 drives the driving reel 3 and the driven reel rotating simultaneously. Yarn 4 is initially wound around the yarn supply reel 1 at the slant surface 24 at the top of the ribs 23 and will slip downward until reaching a rib bottom 241 which located in an annular circle and has a smaller diameter than the diameter of the annular circle of the struts 33. Therefore the yarn will wind around the annular struts 33 evenly.

Both the driving reel 3 and the driven reel 2 are made by plastics injection molding. The ribs 23, slanted and curved surface 24 and the struts 33 can be integrally formed precisely without additional machining or processing. It is easy to provide consistent and high quality in large quantity. They also involve lower cost than conventional ones.

Figure 5:
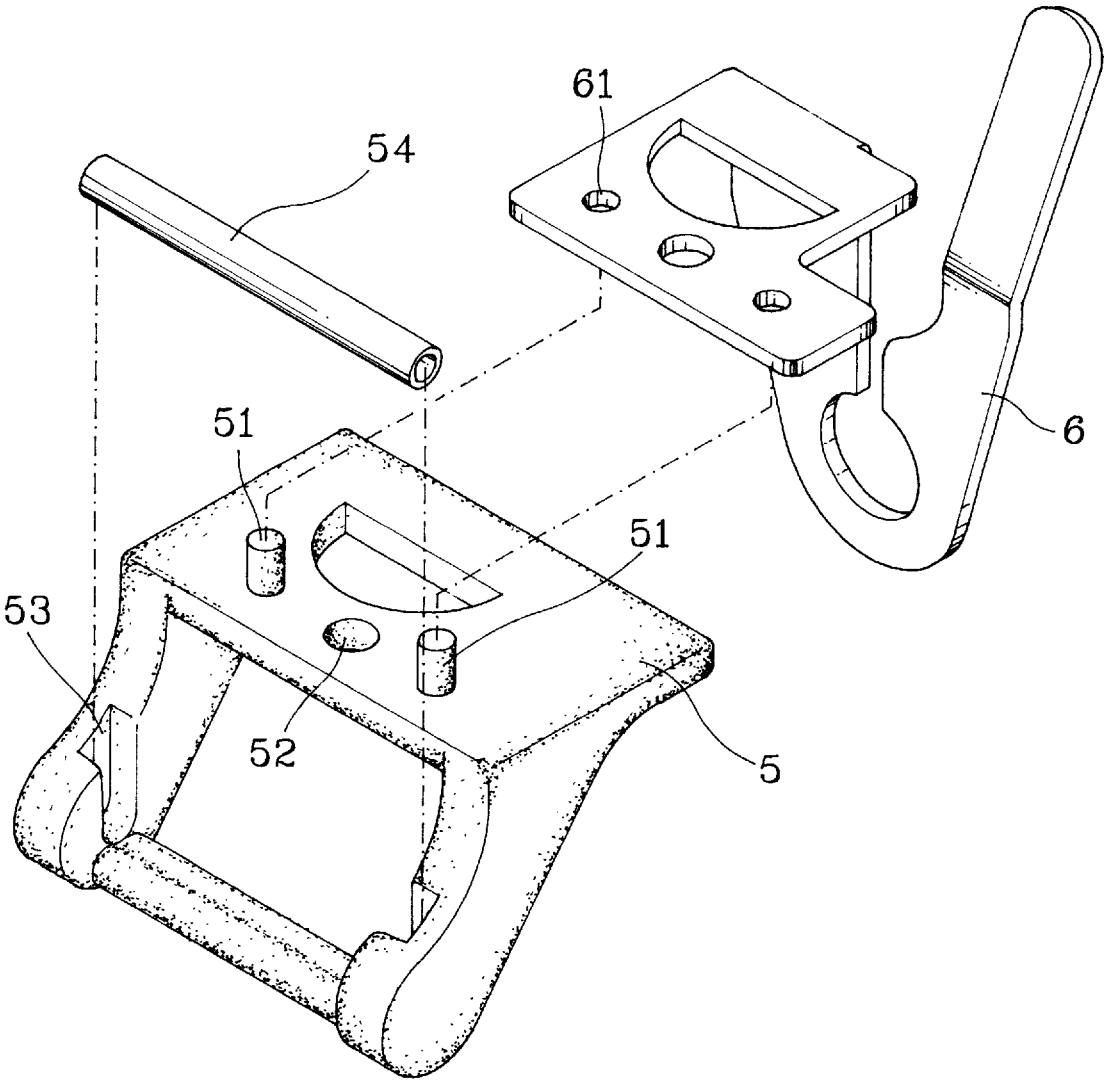
FIG. 5 is an exploded view of a yarn guide according to this invention.

FIG. 5 shows a yarn guide of the present invention. It includes a base frame 5 and a top frame 6. The base frame 5 has a pair of spaced studs 51 and a first opening 52 located therebetween. There are a pair of spaced slots 53 for holding a porcelain rod 54. The top frame 6 has a pair of spaced apertures 61 engageable with the studs 51 and a second opening mating with the first opening 52. The opening 52 allows a screw (not shown in the figure) to fit the yarn guide to the knitting machine.

The yarn guide made in such a way have smooth and curved surfaces and edges, and thus can prevent the yarn from sticking or broken. The yarn guide is also made by plastics injection molding. Its dimensions and allowance can be precisely controlled. It is also lower cost than conventional one.

Through the improvements set forth above, the whole structure can be made much simpler. The production and maintenance is easier. It is lower cost to made. The quality of the knitting product can also be enhanced.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

I claim:

1. An improvement of a yarn supply reel and yarn guide for knitting machines, comprising;

a driving reel having a second spindle opening engageable with a transmission spindle of a knitting machine and a second flange with a plurality of spaced struts vertically formed thereon in annular manner;

a driven reel made by plastics injection molding having a first spindle opening which mates with the second spindle opening and a first flange with a plurality of spaced ribs formed thereunder, each rib having a slanted and curved lateral surface pointing downwardly and inwardly, the first flange having an aperture formed between a pair of the ribs for engaging with a strut; and a yarn guide made by elastics injection molding having curved and smooth surfaces and edges, a through aperture in a top plate and a pair of spaced slots for holding a porcelain rod;

wherein when a yarn enters a yarn supply reel at an upper portion, it is caused to slip along the slanted lateral surface of the yarn supply reel, wind around the struts and then pass over the porcelain rod of a yarn guide before reaching a needle so as to provide a yarn supply at a constant tension.

2. An improvement of a yarn supply reel and yarn guide of claim 1, wherein the yarn guide has a pair of spaced studs on the top plate and a through aperture located therebetween.

* * * * *